US011568690B2

(12) United States Patent
Einberg

(10) Patent No.: US 11,568,690 B2
(45) Date of Patent: Jan. 31, 2023

(54) DETERMINING WHEN ACCESS CONTROL OF AN ELECTRONIC LOCK SHOULD BE PERFORMED

(71) Applicant: ASSA ABLOY AB, Stockholm (SE)

(72) Inventor: Fredrik Einberg, Huddinge (SE)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 17/046,251

(22) PCT Filed: Apr. 16, 2019

(86) PCT No.: PCT/EP2019/059820
§ 371 (c)(1),
(2) Date: Oct. 8, 2020

(87) PCT Pub. No.: WO2019/201933
PCT Pub. Date: Oct. 24, 2019

(65) Prior Publication Data

US 2021/0035391 A1 Feb. 4, 2021

(30) Foreign Application Priority Data

Apr. 18, 2018 (SE) ..... 1850444-9

(51) Int. Cl.
*G07C 9/00* (2020.01)
*E05F 15/77* (2015.01)
*G07C 9/28* (2020.01)

(52) U.S. Cl.
CPC ..... *G07C 9/00309* (2013.01); *E05F 15/77* (2015.01); *G07C 9/28* (2020.01); *G07C 2009/0096* (2013.01); *G07C 2209/64* (2013.01)

(58) Field of Classification Search
CPC ..... G07C 9/00309; G07C 9/28; G07C 2009/0096; G07C 2209/64; E05F 15/77
See application file for complete search history.

(56) References Cited

U.S. PATENT DOCUMENTS 9,870,660 B1 * 1/2018 Patterson ..... G06K 7/10009
2014/0340193 A1 * 11/2014 Zivkovic ..... G07C 9/00309 340/5.61

(Continued)

FOREIGN PATENT DOCUMENTS

| | | |
|---|---|---|
| EP | 3147868 | 3/2017 |
| FR | 2820535 | 8/2002 |
| WO | WO 2018/025086 | 2/2018 |

OTHER PUBLICATIONS

International Search Report and Written Opinion for International (PCT) Patent Application No. PCT/EP2019/059820, dated Jul. 16, 2019, 10 pages.

(Continued)

*Primary Examiner* — Nabil H Syed
(74) *Attorney, Agent, or Firm* — Sheridan Ross P.C.

(57) ABSTRACT

It is provided a method for determining when access control of an electronic lock, controlling access to a restricted physical space, should be performed. The method is performed in an intent determiner and comprising the steps of: obtaining movement data from a first sensor of a portable key device, the movement data indicating movement of the portable key device; obtaining a distance indicator from a second sensor, the distance indicator being indicative of distance between the electronic lock and the user; determining when there is user intent to open based on both the movement data and the distance indicator; and triggering access control to be performed only when user intent has been determined.

12 Claims, 3 Drawing Sheets

(56) References Cited

U.S. PATENT DOCUMENTS

| | | | | |
|---|---|---|---|---|
| 2017/0301166 | A1* | 10/2017 | Earles | G07C 9/00563 |
| 2017/0372549 | A1 | 12/2017 | Einberg | |
| 2018/0234797 | A1* | 8/2018 | Ledvina | B60R 25/24 |
| 2018/0290627 | A1* | 10/2018 | Hariri | B60R 25/245 |

OTHER PUBLICATIONS

Second Written Opinion for International (PCT) Patent Application No. PCT/EP2019/059820, dated Mar. 16, 2020, 6 pages.

International Preliminary Report on Patentability for International (PCT) Patent Application No. PCT/EP2019/059820, dated Aug. 24, 2020, 15 pages.

* cited by examiner

DETERMINING WHEN ACCESS CONTROL OF AN ELECTRONIC LOCK SHOULD BE PERFORMED

CROSS REFERENCE TO RELATED APPLICATIONS

This application is a national stage application under 35 U.S.C. 371 and claims the benefit of PCT Application No. PCT/EP2019/059820 having an international filing date of Apr. 16, 2019, which designated the United States, which PCT application claimed the benefit of Swedish Patent Application No. 1850444-9 filed Apr. 18, 2018, the disclosure of each of which are incorporated herein by reference.

TECHNICAL FIELD

The invention relates to a method, an intent determiner, a computer program and a computer program product for determining when access control of an electronic lock should be performed.

BACKGROUND

Locks and keys are evolving from the traditional pure mechanical locks. These days, there are wireless interfaces for electronic locks, e.g. by interacting with a portable key device. For instance, Radio Frequency Identification (RFID) has been used as the wireless interface.

When RFID is used, the user needs to present the portable key device in close proximity to a reader connected to the lock. Moreover, RFID requires a relatively large antenna in the reader by the lock and uses a large amount of energy. Also, RFID is not an interface which can be used for remote system management of the lock; only system management using an RFID device in close proximity of the lock can be used for such tasks. Hence, to allow remote system management, e.g. configuration and monitoring, a second radio interface needs to be added.

Another solution is to use Ultra High Frequency (UHF). However, with UHF, the range is longer and it is difficult to determine intent. One problem if the lock unlocks whenever a valid portable key device is within range is that when a person on the inside of an electronic lock walks past the electronic lock, the electronic lock would open and anyone could gain access to the restricted physical space.

SUMMARY

It is an object of embodiments presented herein to provide a way to determine user intent of requesting access to a physical space controlled by an electronic lock.

According to a first aspect, it is provided a method for determining when access control of an electronic lock, controlling access to a restricted physical space, should be performed. The method is performed in an intent determiner and comprising the steps of: obtaining movement data from a first sensor of a portable key device, the movement data indicating movement of the portable key device; obtaining a distance indicator from a second sensor, the distance indicator being indicative of distance between the electronic lock and the user; determining when there is user intent to open based on both the movement data and the distance indicator; and triggering to access control to be performed only when user intent has been determined.

The step of obtaining a distance indicator may comprise repeatedly determining a distance to surrounding objects using a distance sensor.

The distance sensor may be a time of flight sensor.

The step of obtaining movement data may comprise obtaining multiple sets of movement data covering a time period; the step of obtaining a distance indicator may comprises obtaining multiple distance indicators covering the time period; and the step of determining when there is user intent may comprise determining user intent to open only when the movement data correlates with the distance indicators during the time period.

The step of determining when there is user intent may comprise comparing a velocity estimated from the movement data with a velocity estimated from the distance indicator over the time period.

The step of determining when there is user intent may comprise comparing an acceleration estimated from the movement data with an acceleration estimated from the distance indicator over the time period.

The method may further comprise the step, prior to the step of obtaining movement data, of: training a machine learning model based on movement data and distance indicators being inputs and user intent to open being expected output. In such a case, the step of determining when there is user intent comprises determining user intent based on the machine learning model.

The step of determining when there is user intent may comprise determining user intent to open only when the movement data indicates a deceleration peak and the distance indicator indicates a deceleration peak, and the deceleration peaks correspond to each other in time.

The step of determining when there is user intent may comprise determining user intent to open only when the movement data indicates a stop in motion of the key device and the distance indicator indicates a stop in motion of the user, and the stops correspond to each other in time.

The step of obtaining a distance indicator may comprise receiving a signal indicating a touch event in proximity of the electronic lock.

The second sensor may be fixed in relation to the electronic lock.

According to a second aspect, it is provided an intent determiner for determining when access control of an electronic lock, controlling access to a restricted physical space, should be performed. The intent determiner comprises: a processor; and a memory storing instructions that, when executed by the processor, cause the intent determiner to: obtain movement data from a first sensor of a portable key device, the movement data indicating movement of the portable key device; obtain a distance indicator from a second sensor, the distance indicator being indicative of distance between the electronic lock and the user; determine when there is user intent to open based on both the movement data and the distance indicator; and trigger access control to be performed only when user intent has been determined.

According to a third aspect, it is provided a computer program for determining when access control of an electronic lock, controlling access to a restricted physical space, should be performed. The computer program comprises computer program code which, when run on an intent determiner causes the intent determiner to: obtain movement data from a first sensor of a portable key device, the movement data indicating movement of the portable key device; obtain a distance indicator from a second sensor, the distance indicator being indicative of distance between the electronic lock and the user; determine when there is user intent to open based on both the movement data and the distance indicator; and trigger access control to be performed only when user intent has been determined.

According to a fourth aspect, it is provided a computer program product comprising a computer program according to the third aspect and a computer readable means on which the computer program is stored.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

According to embodiments presented herein, movement data from a first sensor of a portable key device is correlated with a distance indicator, indicating a distance between an electronic lock and the user. In this way, the a situation when the user is walking up to an electronic lock and stops can be determined to be user intent to open, at which point access control is triggered and the user can access the restricted space, if access is granted. This procedure is extremely user friendly since the user only needs to approach the electronic lock in order to show user intent to open. There is no need for the user to take the portable key device out of any pocket or bag for the access control to commence. It is to be noted that intent as used herein often also implies detecting whether the user is inside or outside a barrier.

Figure 1:
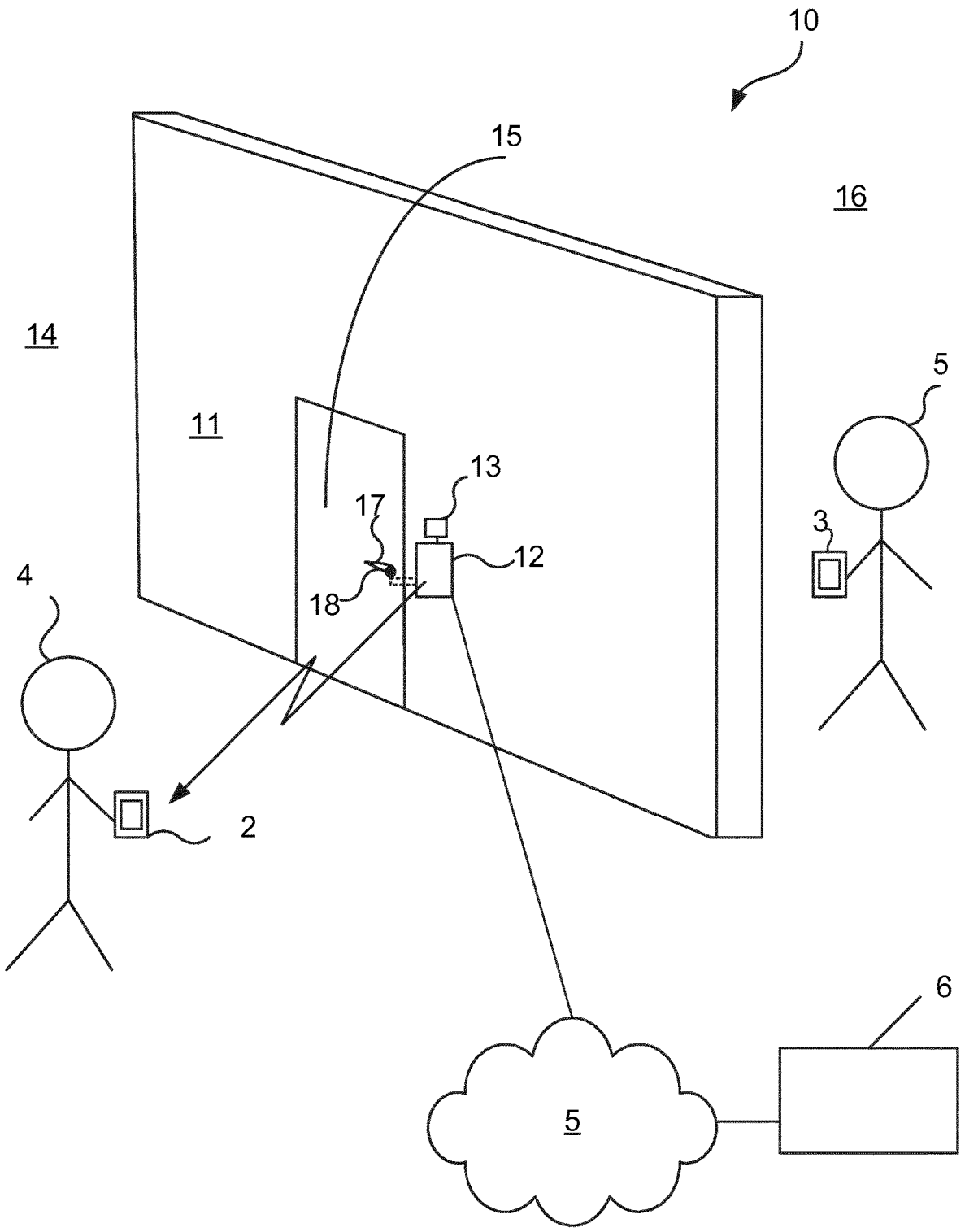
FIG. 1 is a schematic diagram showing an electronics access control system being an environment in which embodiments presented herein can be applied.

FIG. 1 is a schematic diagram showing an electronics access control system 10 being an environment in which embodiments presented herein can be applied. Access to a physical space 16 is restricted by a physical barrier 15, which is selectively unlockable. The physical barrier 15 stands between the restricted physical space 16 and an accessible physical space 14. Note that the accessible physical space 14 can be a restricted physical space in itself, but in relation to this particular physical barrier 15, the accessible physical space 14 is accessible. In other words, the restricted physical space 16 is inside the physical barrier 15 and the accessible physical space 14 is outside the physical barrier 15. The barrier 15 can be a door, gate, hatch, window, drawer, etc. A handle 17 is provided to allow opening of the barrier 15, once unlocked. In order to unlock or lock the barrier 15, an electronic lock 12 is provided. The electronic lock 12 can be in an unlocked state or locked state. The barrier 15 is provided in a surrounding fixed structure 11, such as a wall or fence.

There is a distance sensor 13 provided in proximity to the electronic lock 12. The distance sensor 13 can be provided in the surrounding fixed structure 11. The distance sensor 13 can be a time of flight (ToF) sensor which can measure distance to an object within a specified field of view, allowing the distance to an approaching user 4 to be determined. The ToF sensor comprises an emitter that sends a transmission that is reflected by surrounding objects. The reflected transmission is received by the ToF sensor. By measuring the time between the emitted transmission and received reflected transmission, a distance to surrounding object(s) can be determined. The ToF sensor can be RF (radio frequency) based, and/or light based, such as LIDAR (Light Detection And Ranging). Alternatively or additionally, the distance sensor 13 can comprise one or more 2D cameras and/or 3D cameras, which are used to estimate distance to the user 4 from the distance sensor 13. The handle 17 optionally comprises a touch sensor 18 which can detect when the user 4 touches the handle 17.

The electronic lock 12 is able to receive and send signals from/to portable key devices 2, 3 over a communication channel which may be a short-range wireless interface. Optionally, the electronic lock 12 comprises a separate unit, also known as an access control reader, for communicating with the 3*o* portable key devices 2, 3 and evaluating access. In this example, there is a first portable key device 2 and a second portable key device 3. The portable key devices 2, 3 are implemented using any suitable device which is portable by a user and which can be used by the electronic lock 12 to evaluate whether to grant access or not by communicating over the communication channel. The portable key devices can comprise digital cryptographic keys for electronic authentication.

The portable key devices 2, 3 are typically carried or worn by a user and may be implemented as a smart phone, wearable device, key fob, etc. The portable key device 2, 3 include a first sensor, being a movement sensor which can be implemented e.g. as an accelerometer and/or gyro. In this example, the first portable key device 2 is carried by a first user 4 and the second portable key device 3 is carried by a second user 5. The first user 4 and the first portable key device 2 are located in the accessible physical space 14 and the second user 5 and the second portable key device 3 are located in the restricted physical space 16.

The short-range wireless interface between the portable key devices 2, 3 and the electronic lock 12 is a radio frequency wireless interface and could e.g. employ Bluetooth, Bluetooth Low Energy (BLE), ZigBee, Radio Frequency Identification (RFID), any of the IEEE 802.11 standards, any of the IEEE 802.15 standards, wireless Universal Serial Bus (USB), etc. Using the communication channel, the identity of the portable key devices 2, 3 can be obtained and access control can be performed by the electronic lock 12. The communication over the short-range wireless interface can be encrypted.

When the access control by the electronic lock 12 results in granted access, the electronic lock 12 is set in an unlocked state. When the electronic lock 12 is in the unlocked state, the barrier 15 can be opened and when the electronic lock 12 is in a locked state, the barrier 15 cannot be opened. In this way, access to a closed space 16 is controlled by the electronic lock 12. It is to be noted that the electronic lock 12 can be mounted in the fixed structure 11 by the physical barrier 15 (as shown) or in the physical barrier 15 itself (not shown).

The electronic lock 12 can perform an access control for any portable key device 2, 3 presented to it. However, according to embodiments presented herein, the access control is only performed when user intent is determined. The reason for this is that if access control is performed by the electronic lock 12 whenever a portable key device is within communicable range, the second portable key device 3 in the restricted physical space can result in the electronic lock 12 unlocking when the second user 5 walks by, without user intent to unlocking the electronic lock to open the barrier. An unauthorised person could then open the barrier 15 and gain access to the restricted physical space 16.

User intent can be determined prior to authentication and authorisation of the portable key or vice versa.

The electronic lock optionally contains communication capabilities to connect to a server 6 for the electronics access control system 10 via a network 5. The network can be a wide area network, such as the Internet, to which the portable key devices 2, 3 can connect e.g. via WiFi (e.g. any of the IEEE 802.11x standards) or a cellular network, e.g. LTE (Long Term Evolution), next generation mobile networks (fifth generation, 5G), UMTS (Universal Mobile Telecommunications System) utilising W-CDMA (Wideband Code Division Multiplex), etc.

FIGS. 2A-D are schematic graphs illustrating velocities and accelerations of when user intent to open is shown. In this example, a user walks and approaches an electronic lock, until the person stops at time to.

Figure 2A:
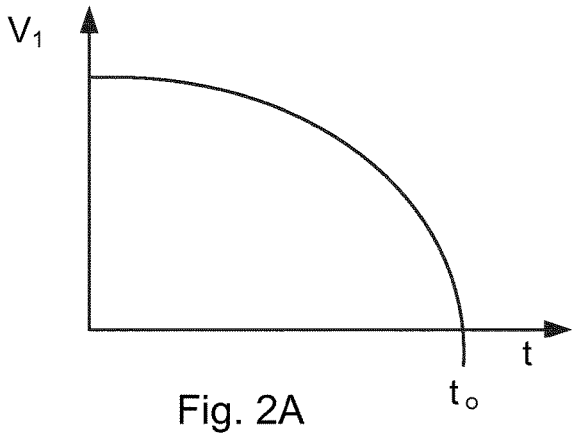
FIGS. 2A-D are schematic graphs illustrating velocities and accelerations of when intent to open is shown.

In FIG. 2A, a first velocity estimate v1 is shown over time. The first velocity v1 is estimated using a motion sensor in the first portable key device 2 of FIG. 1. The first velocity v1 can e.g. be obtained by integrating acceleration measurements over time.

Figure 2C:
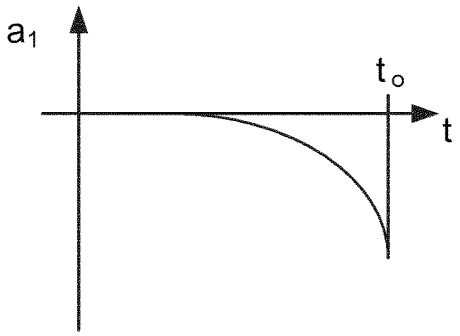
Figure 2B:
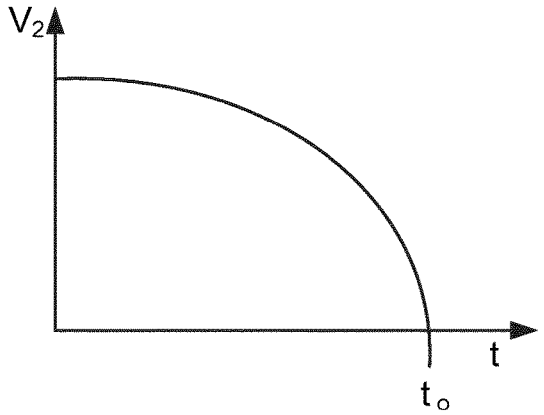

In FIG. 2B, a second velocity estimate v2 is shown over time. The second velocity v2 is estimated using a distance indicator from the distance sensor in proximity to the electronic lock 12. The second velocity v2 can e.g. be obtained by differentiating the distance indicator over time.

It can be seen both in FIGS. 2A and 2B how the velocities v1, v2 decrease as time to approaches, at which time the velocity is zero since the user has stopped.

By correlating velocities v1 and v2, it can be determined if the velocities v1, v2 match, at which point user intent to open can be determined. The correlation can be calculated using any suitable known correlation calculation, e.g. root mean square error on normalised velocities or autocorrelation. Optionally, it is a requirement that the velocities v1, v2 need to reach zero at the same time (within a margin of error) for user intent to open to be determined.

Optionally, it is first determined that the user has stopped. This point is then used as a reference point where velocity is zero. Acceleration data prior to the stopped time is then used to determine the velocity curve.

In FIG. 2C, a first acceleration estimate a1 is shown over time. The first acceleration a1 is estimated using a motion sensor in the first portable key device 2 of FIG. 1. The first acceleration a1 can e.g. be obtained from acceleration measurements from an accelerometer.

Figure 2D:
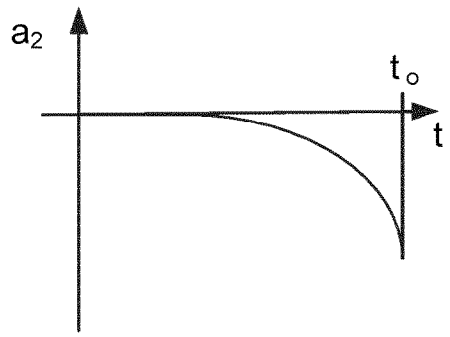

In FIG. 2D, a second acceleration estimate a2 is shown over time. The second acceleration a2 is estimated using the distance indicator from the distance sensor in proximity to the electronic lock 12. The second acceleration a2 can e.g. be obtained by double differentiating the distance indicator over time.

By correlating accelerations a1 and a2, it can be determined if the accelerations a1, a2 match, at which point user intent to open can be determined. The correlation can be calculated using any suitable known correlation calculation, e.g. mean square error on normalised accelerations. Optionally, it is a requirement that the accelerations a1, a2 need to exhibit a sharp negative peak, i.e. deceleration, at about the same time for user intent to open to be determined.

Figure 3A:
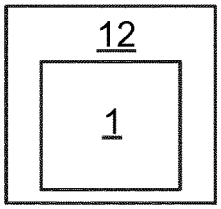
FIGS. 3A-3D are schematic diagrams illustrating embodiments of where the intent determiner can be implemented.
Figure 3B:
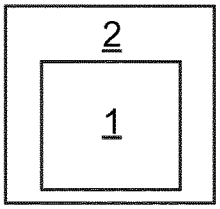

FIGS. 3A-B are schematic diagrams illustrating embodiments of where the intent determiner 1 can be implemented. The intent determiner 1 is used for determining when access control of an electronic lock should be performed.

In FIG. 3A, the intent determiner 1 is shown as implemented in the electronic lock 12. The electronic lock 12 is thus the host device for the intent determiner 1. Optionally, the intent determiner 1 is implemented in a separate access control reader forming part of the electronic lock 12.

In FIG. 3B, the intent determiner 1 is shown as implemented in the portable key device 2. The portable key device 2 is thus the host device for the intent determiner 1.

Figure 3C:
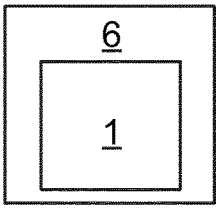

In FIG. 3C, the intent determiner 1 is shown as implemented in the server 6. The server 6 is thus the host device for the intent determiner 1.

Figure 3D:
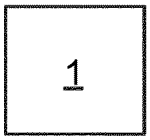

In FIG. 3D, the intent determiner 1 is shown implemented as a stand-alone device.

Figure 4:
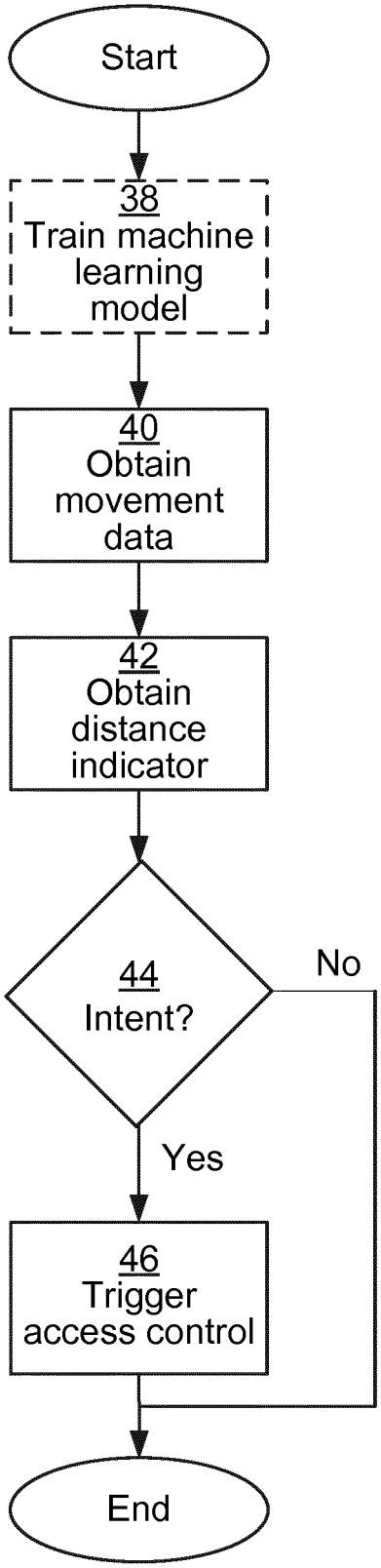
FIG. 4 is a flow chart illustrating embodiments of methods for determining when access control of an electronic lock should be performed.

FIG. 4 is a flow chart illustrating embodiments of methods for determining when access control of an electronic lock should be performed. As described above, the electronic controls access to a restricted physical space. The method is performed in an intent determiner.

In an optional train machine learning model step 38, the intent determiner trains a machine learning model based on movement data and distance indicators being inputs and user intent to open being expected output. In the training phase, the user intent to open is implemented using a separate user input, allowing a user to indicate when user intent to open is actually shown and when it is not. The separate user input for indicating when user to open intent occurs is only used in the training phase. Optionally, the training the machine learning model can occur in a different device than the intent determiner. The training can occur long before the rest of the steps of the method.

In an obtain movement data step 40, the intent determiner obtains movement data from a first sensor of a portable key device. The movement data (captured by the first sensor forming part of the portable key device) indicates movement of the portable key device. As described above, the movement data can be based on measurements from an accelerometer and/or gyro of (forming part of) the portable key device, in which case the first sensor comprises the accelerometer and/or gyro.

Optionally, multiple sets of movement data covering a time period are obtained. This allows e.g. the first velocity of FIG. 2A and/or the first acceleration of FIG. 2C to be determined.

Optionally, movement can be based on the accelerometer where movement along a gravitational axis is removed from the movement data. The movement in the gravitational axis is often noisy (e.g. due to steps when a user is walking/running) and does not contribute much to the ability to determine user intent to open. Optionally, the movement data is subsequently quantified as the magnitude of in a plane perpendicular to the gravitational axis.

In an obtain distance indicator step 42, the intent determiner obtains a distance indicator from a second sensor. The distance indicator is indicative of distance between the electronic lock and the user. The second sensor can fixed in relation to the electronic lock, when the barrier is in a closed state. For instance, the second sensor can be mounted in the surrounding fixed structure (if of FIG. 1) or on the barrier (15 of FIG. 1).

Optionally, multiple distance indicators are obtained covering the time period, i.e. covering the same time period for which multiple sets of movement data are obtained in step 40. This allows e.g. the second velocity of FIG. 2B and/or the second acceleration of FIG. 2D to be determined.

In one embodiment, distance indicator comprises a signal indicating a touch event in proximity of the electronic lock. The touch event can be the only component of the distance indicator or the touch event can be combined with the distance determination described below. The touch event can be a binary indicator indicating that a user has touched the touch sensor.

In one embodiment, a distance to surrounding objects is repeatedly determined using a distance sensor. The distance sensor is then the second sensor. The distance sensor can be a time of flight sensor. Alternatively or additionally, the distance sensor is based on image processing based on one or more 2D cameras and/or 3D cameras. Alternatively or additionally, the distance sensor is based on radar or LIDAR (Light Detection And Ranging).

In a conditional intent step 44, the intent determiner determines when there is user intent to open based on both the movement data and the distance indicator.

For instance, one necessary condition for user intent to open can be that the movement data indicates a deceleration peak and the distance indicator indicates a deceleration peak, and the deceleration peaks correspond to each other in time.

Alternatively or additionally, one necessary condition for user intent to open can be that the movement data indicates a stop in motion of the key device and the distance indicator indicates a stop in motion of the user, and the stops correspond to each other in time.

Alternatively or additionally, one necessary condition for user intent to open can be that the movement data correlates with the distance indicators during the time period mentioned above. The matching can be performed by correlating corresponding metrics, e.g. velocity, speed, where the correlation needs to be better than a certain threshold.

The matching can e.g. be based on comparing a velocity estimated from the movement data with a velocity estimated from the distance indicator over the time period, as illustrated in FIGS. 2A and 2B and described above.

Alternatively or additionally, the matching can be based on comparing an acceleration estimated from the movement data with an acceleration estimated from the distance indicator over the time period, as illustrated in FIGS. 2C and 2D and described above.

In one embodiment, user intent to open is determined based on the machine learning model. It has been found that machine learning is well suited for this user intent determination and results in very few false negatives (i.e. missed occasions of detecting actual user intent to open) and very few false positives (i.e. determined user intent when there is no actual user intent to open).

In one embodiment, the movement data of the portable key device is matched in time with the touch sensor, such that if a person walks up to the electronic lock and touches the touch sensor, the stop of movement needs to occur within a specified time from when the user touches the touch sensor.

In a trigger access control step 46, the intent determiner triggers access control to be performed.

Optionally, the electronic lock can include a user input device, such as a push button or touch sensor, allowing a user to explicitly show user intent to open if the embodiments presented herein on rare occasions fail to automatically determine user intent to open of the user.

By evaluating both the movement data and the distance indicator, user intent to open the lock of a user can be determined without explicit user indication, allowing the electronic lock to function with optimal user experience.

Figure 5:
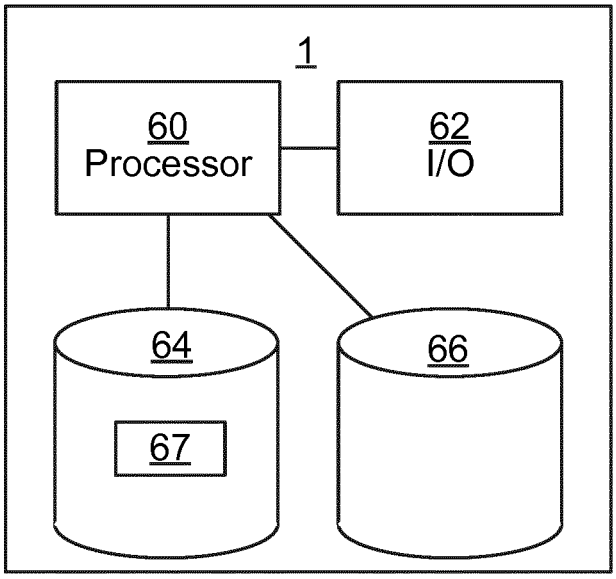
FIG. 5 is a schematic diagram illustrating components of the intent determiner of FIGS. 3A-D.

FIG. 5 is a schematic diagram illustrating components of the intent determiner of FIGS. 3A-D. It is to be noted that one or more of the mentioned components can be shared with the host device, when the intent determiner forms part of a host device. A processor 60 is provided using any combination of one or more of a suitable central processing unit (CPU), multiprocessor, microcontroller, digital signal processor (DSP), etc., capable of executing software instructions 67 stored in a memory 64, which can thus be a computer program product. The processor 60 could alternatively be implemented using an application specific integrated circuit (ASIC), field programmable gate array (FPGA), etc. The processor 60 can be configured to execute the method described with reference to FIG. 4 above.

The memory 64 can be any combination of random access memory (RAM) and/or read only memory (ROM). The memory 64 also comprises persistent storage, which, for example, can be any single one or combination of magnetic memory, optical memory, solid-state memory or even remotely mounted memory.

A data memory 66 is also provided for reading and/or storing data during execution of software instructions in the processor 60. The data memory 66 can be any combination of RAM and/or ROM.

The intent determiner 1 further comprises an I/O interface 62 for communicating with other external entities.

Other components of the intent determiner 1 are omitted in order not to obscure the concepts presented herein.

Figure 6:
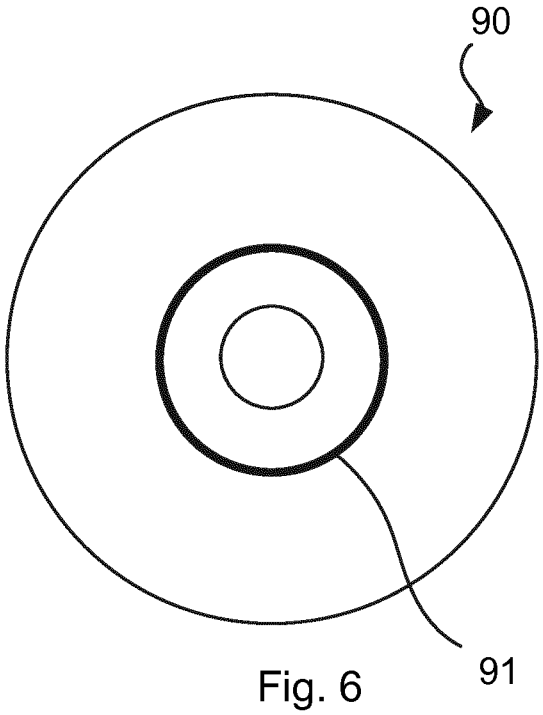
FIG. 6 shows one example of a computer program product comprising computer readable means.

FIG. 6 shows one example of a computer program product 90 comprising computer readable means. On this computer readable means, a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device, such as the computer program product 64 of FIG. 5. While the computer program 91 is here schematically shown as a track on the depicted optical disk, the computer program can be stored in any way which is suitable for the computer program product, such as a removable solid state memory, e.g. a Universal Serial Bus (USB) drive.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method for determining when access control of an electronic lock, controlling access to a restricted physical space, should be performed, the method being performed in an intent determiner and comprising:

obtaining movement data from a first sensor of a portable key device, the movement data indicating movement of the portable key device;

obtaining a distance indicator from a second sensor, the distance indicator being indicative of distance between the electronic lock and the user;

determining a deceleration peak in the movement data and determining a time of the deceleration peak in the movement data;

determining a deceleration peak in the distance indicator and determining a time of the deceleration peak in the distance indicator;

determining when there is user intent to open based on both the movement data and the distance indicator, which comprises determining user intent to open only when the deceleration peak is determined in the movement data and the deceleration peak is determined in the distance indicator, and the determined times of the deceleration peaks correspond to each other; and triggering access control to be performed only when user intent has been determined.

2. The method according to claim 1, wherein obtaining a distance indicator comprises repeatedly determining a distance to surrounding objects using a distance sensor.

3. The method according to claim 2, wherein the distance sensor is a time of flight sensor.

4. The method according to claim 2, wherein:

obtaining movement data comprises obtaining multiple sets of movement data covering a time period;

obtaining a distance indicator comprises obtaining multiple distance indicators covering the time period; and determining when there is user intent comprises determining user intent to open only when the movement data correlates with the distance indicators during the time period.

5. The method according to claim 4, wherein determining when there is user intent comprises comparing a velocity estimated from the movement data with a velocity estimated from the distance indicator over the time period.

6. The method according to claim 4, wherein determining when there is user intent comprises comparing an acceleration estimated from the movement data with an acceleration estimated from the distance indicator over the time period.

7. The method according to claim 4, further comprising:

training a machine learning model based on movement data and distance indicators being inputs and user intent to open being expected output; and wherein determining when there is user intent comprises determining user intent based on the machine learning model.

8. The method according to claim 1, wherein determining when there is user intent comprises determining user intent to open only when the movement data indicates a stop in motion of the portable key device and the distance indicator indicates a stop in motion of the user, and the stops in motion of the portable key device and the user correspond to each other in time.

9. The method according to claim 1, wherein obtaining the distance indicator comprises receiving a signal indicating a touch event in proximity of the electronic lock.

10. The method according to claim 1, wherein the second sensor is fixed in relation to the electronic lock.

11. An intent determiner for determining when access control of an electronic lock, controlling access to a restricted physical space, should be performed, the intent determiner comprising:

a processor; and a memory storing instructions that, when executed by the processor, cause the intent determiner to:

obtain movement data from a first sensor of a portable key device, the movement data indicating movement of the portable key device;

obtain a distance indicator from a second sensor, the distance indicator being indicative of distance between the electronic lock and the user;

determine a deceleration peak in the movement data and determine a time of the deceleration peak in the movement data;

determine a deceleration peak in the distance indicator and determine a time of the deceleration peak in the distance indicator;

determine when there is user intent to open based on both the movement data and the distance indicator, which comprises to determine user intent to open only when the deceleration peak is determined in the movement data and the deceleration peak is determined in the distance indicator, and the determined times of the deceleration peaks correspond to each other; and trigger access control to be performed only when user intent has been determined.

12. A non-transitory computer-readable medium comprising a computer program stored thereon for determining when access control of an electronic lock, controlling access to a restricted physical space, should be performed, the computer program comprising computer program code which, when run on an intent determiner causes the intent determiner to:

obtain movement data from a first sensor of a portable key device, the movement data indicating movement of the portable key device;

obtain a distance indicator from a second sensor, the distance indicator being indicative of distance between the electronic lock and the user;

determine a deceleration peak in the movement data and determine a time of the deceleration peak in the movement data;

determine a deceleration peak in the distance indicator and determine a time of the deceleration peak in the distance indicator;

determine when there is user intent to open based on both the movement data and the distance indicator, which comprises to determine user intent to open only when the deceleration peak is determined in the movement data and the deceleration peak is determined in the distance indicator, and the determined times of the deceleration peaks correspond to each other; and trigger access control to be performed only when user intent has been determined.

* * * * *